United States Patent [19]

Muz

[11] 4,120,553

[45] Oct. 17, 1978

[54] PLUG HOUSING FOR MULTIPOLAR PLUG CONNECTORS

[75] Inventor: Edwin Muz, Mühlbach-Eppingen, Germany

[73] Assignee: Siemens Aktiengesellschaft, Berlin & Munich, Germany

[21] Appl. No.: 839,982

[22] Filed: Oct. 6, 1977

Related U.S. Application Data

[63] Continuation of Ser. No. 531,104, Dec. 9, 1974, abandoned.

[30] Foreign Application Priority Data

Dec. 10, 1973 [DE] Fed. Rep. of Germany ... 7343790[U]

[51] Int. Cl.[2] ..... H01R 13/54

[52] U.S. Cl. ..... 339/91 R; 339/143 R; 339/196 A

[58] Field of Search ..... 339/91 R, 143 R, 196 R, 339/196 A, 196 M

[56] References Cited

U.S. PATENT DOCUMENTS

| | | | |
|---|---|---|---|
| 2,163,412 | 6/1939 | Schneider | 339/143 R |
| 2,669,702 | 2/1954 | Klostermann | 339/196 M |
| 2,895,119 | 7/1959 | Montgomery | 339/91 R |
| 3,204,212 | 8/1965 | Broder | 339/196 M |
| 3,587,035 | 6/1971 | Kotski | 339/143 R |

FOREIGN PATENT DOCUMENTS

| | | | |
|---|---|---|---|
| 1,102,237 | 3/1961 | Fed. Rep. of Germany | 339/91 R |
| 1,590,489 | 5/1970 | Fed. Rep. of Germany. | |
| 1,765,256 | 7/1971 | Fed. Rep. of Germany. | |
| 1,232,887 | 4/1960 | France. | |
| 1,293,239 | 4/1962 | France. | |

*Primary Examiner*—Neil Abrams

*Attorney, Agent, or Firm*—Hill, Gross, Simpson, Van Santen, Steadman, Chiara & Simpson

[57] ABSTRACT

A plug housing for multipolar plug connectors, essentially consisting of two equal, mirror-image joined half-shells which are formed of plastic material, including cutouts for receiving one plug connector element, its connector cable and a pull-release clip for the latter, and externally actuatable locking clamps which, in cooperation with arresting projections in a connector receptacle containing the other plug connector component, forms a releasable locking arrangement.

1 Claim, 5 Drawing Figures

PLUG HOUSING FOR MULTIPOLAR PLUG CONNECTORS

This is a continuation of application Ser. No. 531,104, filed Dec. 9, 1974, now abandoned.

FIELD OF THE INVENTION

The present invention relates to a plug housing for multipolar plug connectors, essentially consisting of two equal, mirror-image joined half-shells which are formed of plastic material, including cutouts for receiving one plug connector element, its connector cable and a pull-release clip for the latter, and externally actuatable locking clamps which, in cooperation with arresting projections in a connector receptacle containing the other plug connector component, forms a releasable locking arrangement.

DISCUSSION OF THE PRIOR ART

As a rule, multipolar plug connectors generally each consist of a block of insulating material which is provided with a fastening flange, and within which there are fastened the individual contact elements. For trouble-free manipulation or handling, the connections of the cable wires to the contact elements, which are sensitive to tension and buckling, must be protected from loads in such a way that they are covered by a housing to which the cable end is fixedly connected for protection against tension. Since the depth of insertion of the individual contact elements into the complementary opposite poles frequently comprises only a few millimeters, provision must be made that an incomplete connection and inadvertent soldering of the plug connection is prevented by a locking arrangement. Solutions of this problem are known in the form of covering caps of plastic material or metal into which there is inserted and fastened a plug connector component, and whereby metallic caps are particularly advantageous due to their screening or protective effects.

Also known are plug housings formed of plastic materials, which consist of two half-shells, having inserted therein the plug connector component which is fastened to the cable, and with the half-shells then being screwed together.

Plug housings of plastic material, due to their material accumulations which are necessary for the fastening of the cable and the plug connector component, for example, for receiving of threaded sleeves, are difficult and expensive to manufacture. In plug housings constructed of two half-shells, the known connection by means of a plurality of screws in quite complex and insecure, since plastic materials tend to cold-flow and to yield to the screw pressure with time.

SUMMARY OF THE INVENTION

Accordingly, it is an object to provide a plug housing which may be simply constructed and mounted, and which does not exhibit disadvantages encountered in the known plug housings.

The foregoing object is attained through the present invention in a plug housing of the above-mentioned type, which is characterized in that a hood formed of slightly elastic plastic material is provided for the fastening together of the joined half-shells and adapted to be slid thereon, which includes cutouts for receiving of engaging projections of the half-shells, and for the through passage of the actuating elements for the locking clamps.

The half-shells facilitate the simple and rapid mounting of the components which are to be assembled in the plug housing, so that the sliding on of the hood which fastens the half-shells together may be carried out without the aid of tools.

In order to achieve the frequently required screening effect of the plug housing with respect to electrical interference fields, the half-shells, and/or the hood fastening these together, may be provided with a metallized outer surface or outer surface metal coating. It is also possible to construct the hood of an electrically-conductive plastic material.

BRIEF DESCRIPTION OF THE DRAWINGS

Further advantages and exemplary constructions may now be ascertained from the following detailed description of the invention showing an illustrative embodiment, taken in conjunction with the accompanying drawings; in which.

DETAILED DESCRIPTION

Figure 1:
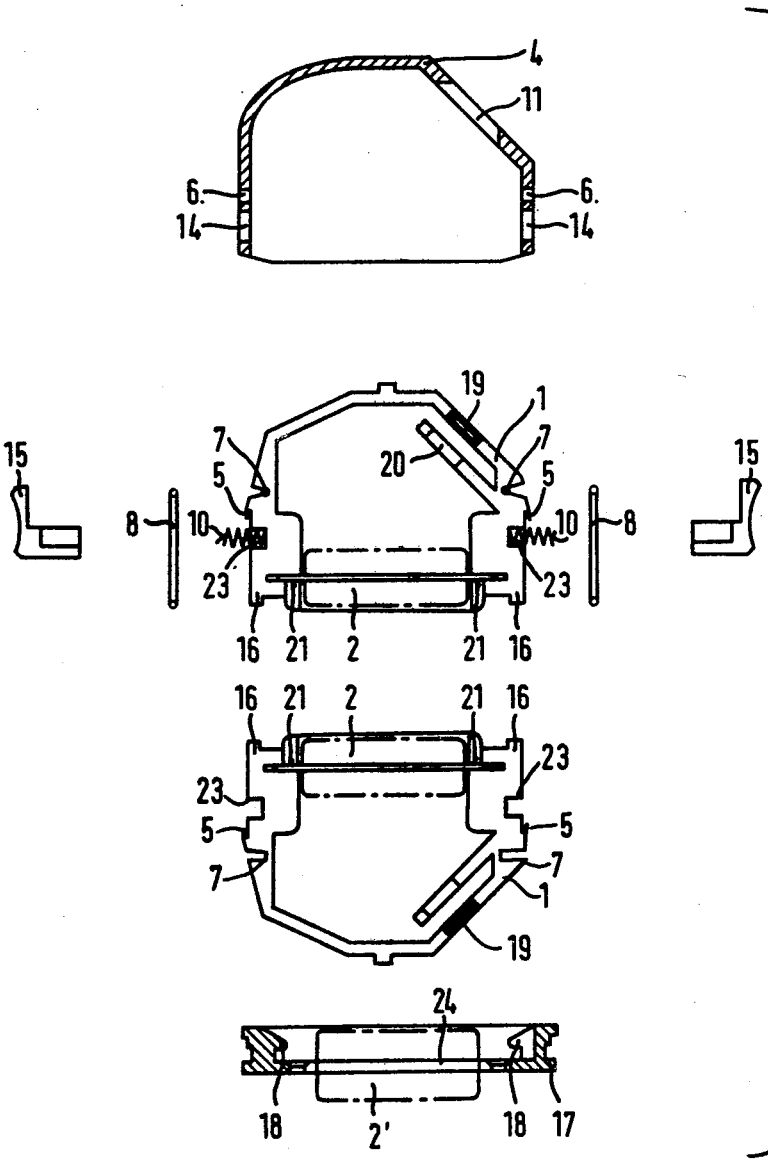
FIG. 1 illustrates an exploded view of all of the components of the plug housing.

Referring now in detail to the drawings, illustrated in FIG. 1 is a half-shell 1 of a plug housing, which is so situated in the drawing that a separating plane of a housing constructed of two half-shells of that type is positioned in the plane of the drawing. The half-shell 1 includes two apertures or cutouts 19 and 20 which, in conjunction with the corresponding cutouts of the other half-shell, form the apertures for the insertion of a connector cable and for the fastening of the pull-release clip for the connector cable. Into slits 21 formed in the inner wall, there may be inserted the plug connector component 2, shown here in chain-dotted lines. Further cutouts 23 serve for receiving return springs 10 for the locking clamps 8, which are formed of spring wire bent essentially into U-shape, and adapted to be snapped into bearing locations 7 in the half-shells 1. For effecting the actuation of the locking clamps 8 there are provided actuating elements 15. The other plug connector component 2', for example, a terminal-strip, projects through a cutout 24 in a connector receptacle 17, the latter of which is rigidly connected to a support base. The connector receptacle 17 additionally includes arresting projections 18 which operatively cooperate with the locking clamps 8 in the plug housing. Protuberances 16 located on the bottom side of the plug housing extend into complementary cutouts formed in the rim of the connector receptacle 17 so that, in a known manner, the two plug connector components 2 and 2' are adapted to be correctly connected without mistake.

A hood 4 approximates in its configuration or profile the assembled half-shells 1 and is so dimensioned that it may be slid onto the assembled half-shells 1 of the plug housing in close fit therewith, so that in the final assembled position the projections 5 of the half-shells engage in cutouts 6 formed in hood 4. A further cutout 11 serves for the insertion of the connector cable, and the cutouts 14 for the insertion of the actuating elements 15 for the releasable locking arrangement.

Figure 2B:
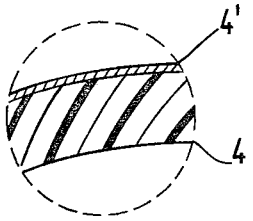
FIG. 2*b* is a enlarged fragmentary cross-sectional view of a hood embodiment which may form a portion of the plug housing.
Figure 2:
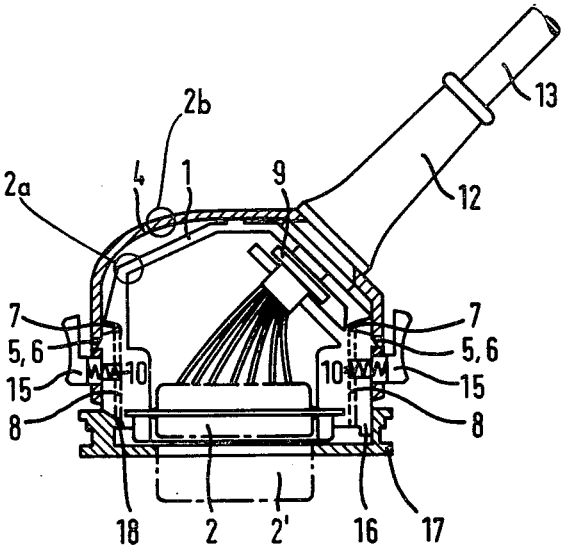
FIG. 2 is a sectional view of an assembled plug connector with the housing of FIG. 1.
Figure 2A:
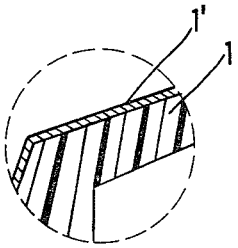
FIG. 2*a* is an enlarged fragmentary cross-sectional view of a half-shell embodiment which may form a portion of the plug housing.

Referring now to FIG. 2 of the drawings, this illustrates the components of FIG. 1 in a mounted and fully equipped plug housing, wherein the same components are designated by the same reference numerals. In certain embodiments, each of the half-shells 1 may be provided with a metallized outer surface 1' and the hood 4 may be provided with a metallized outer surface 4', as shown in FIGS. 2*a* and 2*b*, respectively.

Thus, as may be ascertained the connector cable 13 including a socket 12, which is retained in the plug housing by means of the pull-release clip 9. The wires of the connector cable 13 are connected with the inserted plug connector component 2. The plug housing is introduced into the connector receptacle with its protuberances, and the two components 2 and 2' of the plug connector are locked in engagement with each other.

The locking clamps 8 are, as may be ascertained, engaged or snapped in behind the arresting projections 18 of the connector receptacle 17, and are retained therein by means of the return springs 10. For effecting the release of the plug connector, and the thereby required release of the locking arrangement between the plug housing and the connector receptacle, the actuating elements 15 are inwardly pressed in opposition to the force of the return springs 10 so that the locking clamps 8 disengage.

Figure 3:
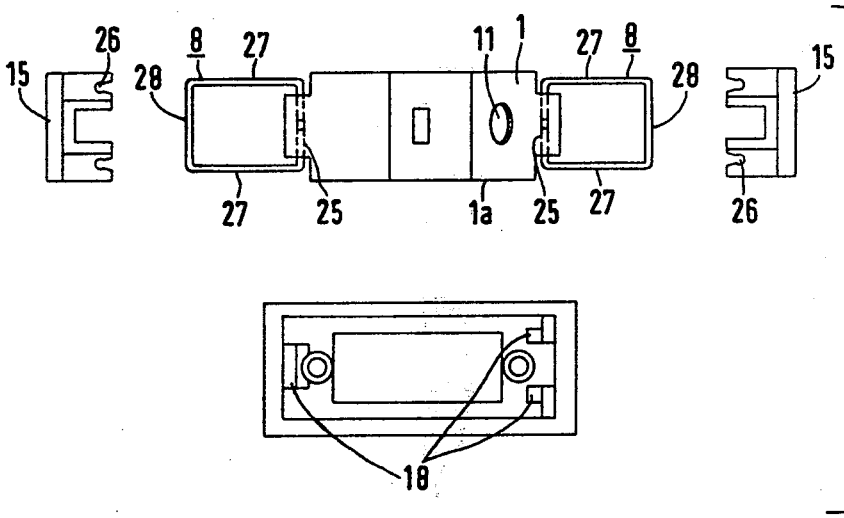
FIG. 3 shows an exploded view of a locking clamp for the plug housing.

From FIG. 3 of the drawings there may be ascertained the rectangular form of the locking clamps 8. The clamps are pivotally supported along the narrow side 25 thereof at bearing locations 7 in the plug housing, while the actuating elements 15 have clamping apertures 26 by means of which the elements 15 are fastened to the longer sides 27 of the clamps 8. (The insertion of the elements is carried out perpendicular to the plane of the locking clamps). The second narrow side 28 of the clamps is designed to grip below the projections 18 of the other plug connector component 2', by means of which there is effected the interconnection of the two plug components. Upon the pressing together of the elements 15, the clamps are inwardly moved, and thus withdrawn from operative engagement with the projections 18. In this condition, the plug connector may then be detached.

While there has been shown what is considered to be the preferred embodiment of the invention, it will be obvious that modifications may be made which come within the scope of the disclosure of the specification.

What is claimed is :

1. In a plug housing for an elongated multi-pin electrical plug connector comprising, in combination:

two substantially identical mirror-image half-shells matable along peripheral side edges thereof to form a substantially rigid housing having a chamber therein with an opening along the bottom of said housing, each of said half-shells having a plurality of cut-outs located along peripheral side wall portions thereof and a plurality of projections located along peripheral side walls thereof and extending outwardly from said side walls, a first pair of mating cut-outs of said half-shells being adapted for receiving a first elongated multi-pin electrical plug connector within the opening of the housing formed by said half-shells, said first pair of cut-outs maintaining said first elongated plug connector in a fixed position relative to the bottom opening of the chamber within the housing formed by said half-shells, a second pair of mating cut-outs of said half-shells spaced from said first pair of cut-outs and being adapted for receiving a connector cable for said first elongated plug connector and for receiving and fastening a pull-release clip associated with said cable, a third pair of mating cut-outs of said half-shells spaced from said first and second pair of cut-outs and being adapted for receiving an externally actuable locking means, a fourth pair of mating cut-outs of said half-shells spaced from said first, second and third pair of cut-outs and being adapted for receiving actuating elements for said locking means, a first pair of mating projections of said half-shells being adapted for engaging cut-outs in a hood positionable over the housing formed by said half-shells, a second pair of mating projections of said half-shells spaced from said first pair of projections and being adapted to contact inner surfaces of a hood positionable over the housing formed by said half-shells, a third pair of mating projections of said half-shells spaced from said first and second pair of projections and being adaptable to mate with arresting projections of a connector receptacle positionable along a bottom of the housing formed by said shell halves;

a first elongated multi-pin electrical plug connector positioned within said first pair of cut-outs of said half-shells and across the bottom opening of the chamber within the housing formed by said half-shells;

a connector cable and associated pull-release clip associated with said cable positioned within said second pair of cut-outs of said half-shells, said cable being electrically connected with individual poles of said first multi-pin plug connector;

a connector receptacle having attached thereto a second elongated multi-pin plug connector matable with said first elongated plug connector, said connector receptacle being releasably attached along the bottom of the housing formed by said half-shells and in communication with the bottom opening of said housing, said connector receptacle having arresting projections along inner side wall portions thereof, said arresting projections mating with said third pair of projections of said half-shells so that said second multi-pin plug connector mates with said first multi-plug connector;

an externally actuated locking means operationally associated with the housing formed by said half-shells, said locking means being adapted for releasably engaging said arresting projections of said connector receptacle and automatically locking said first and second elongated plug connectors together upon joining of said housing and said connector receptacle and releasing said plug connectors in response to external manipulation of said locking means, said locking means comprising bent spring wires positioned within said third pair of cut-outs of said half-shells and actuating elements having surface portions in operational contact with said wires and being positioned within said fourth pair of cut-outs in said half-shells, said actuating elements having surface portions extending externally of said housing for manipulation externally of said housing, and a hood formed of a slightly elastic material adapted to fit over the housing formed by said half-shells and to hold said half-shells in an assembled position, said hood having a plurality of cut-outs along peripheral side wall portions thereof adapted to mate with at least some of the plurality of cut-outs in the housing formed by said half-shells, said hood having interior walls defining a chamber having a bottom opening therein for receiving the housing formed by said half-shells;

said inner surfaces of the hood being in contact with said second pair of mating projections of said half-shells so as to define a space between said inner surfaces and the exterior wall of said housing;

at least one of the cut-outs of said hood engaging said first pair of mating projections of said half-shells and maintaining said hood in fixed relation to the housing formed by said half-shells, whereby said hood is rapidly attachable to the housing formed by said half-shells in a simple and substantially frictionless transitory movement.

* * * * *